US009045704B2

(12) United States Patent
Kuske et al.

(10) Patent No.: US 9,045,704 B2
(45) Date of Patent: Jun. 2, 2015

(54) GASIFICATION REACTOR FOR PRODUCTION OF CRUDE GAS CONTAINING CO OR H2

(75) Inventors: Eberhard Kuske, Soest (DE); Johannes Dostal, Dortmund (DE); Reinald Schulze Eckel, Muenster (DE); Lothar Semrau, Essen (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 700 days.

(21) Appl. No.: 13/387,481

(22) PCT Filed: Jul. 16, 2010

(86) PCT No.: PCT/EP2010/004337

§ 371 (c)(1), (2), (4) Date: Apr. 3, 2012

(87) PCT Pub. No.: WO2011/012229

PCT Pub. Date: Feb. 3, 2011

(65) Prior Publication Data

US 2012/0189499 A1 Jul. 26, 2012

(30) Foreign Application Priority Data

Jul. 27, 2009 (DE) ..... 10 2009 034 870

(51) Int. Cl.
*B01J 7/00* (2006.01)
*C10J 3/48* (2006.01)
(Continued)

(52) U.S. Cl.
CPC *C10J 3/485* (2013.01); *C10J 3/487* (2013.01); *C10J 3/76* (2013.01); *C10J 3/82* (2013.01); *C10J 3/845* (2013.01); *C10J 2200/09* (2013.01)

(58) Field of Classification Search
CPC ..... C10J 3/485; C10J 3/845; C10J 2200/09; C10J 2300/093; C10J 2300/0943; C10J 2300/0956; C10J 2300/0959; C10J 2300/1634; C10J 3/526; C10J 3/78; C10J 3/84; C10J 2200/156; C10J 2300/0903; B01J 2208/00761; B01J 8/003; B01J 8/1836
See application file for complete search history.

(56) References Cited

U.S. PATENT DOCUMENTS 4,459,136 A * 7/1984 Linneborn et al. ..... 48/111
4,474,584 A 10/1984 Koog
(Continued)

FOREIGN PATENT DOCUMENTS

DE 10 2005 041931 3/2007
DE 10 2009 005 464 8/2010
(Continued)

OTHER PUBLICATIONS

International Search Report of PCT/EP2010/04337, dated May 11, 2011.
(Continued)

*Primary Examiner* — Imran Akram
(74) *Attorney, Agent, or Firm* — Collard & Roe, P.C.

(57) ABSTRACT

A gasification reactor for producing crude gas, containing CO or $H_2$, by gasification of ash-containing fuel with oxygen-containing gas, at temperatures above the melting temperature of the ash, has a reaction chamber formed by a membrane wall through which coolant flows, within a pressure container, is provided, with a narrowing transition channel into a gas cooling chamber, and spin-reducing, cooled bulkheads in the transition channel. The, wall that carries the bulkheads makes a transition, below the bulkheads, into a cylinder wall that is reduced in diameter, by way of a step having a corrugated surface. The cylinder wall, which is reduced in diameter, is enclosed by a further cylindrical wall, which is enlarged in diameter, which wall forms a second slag drip edge at its end, in the direction of gravity. The further cylindrical wall is disposed to be adjustable in its vertical position, with reference to the first drip edge.

4 Claims, 2 Drawing Sheets

Figure 1:
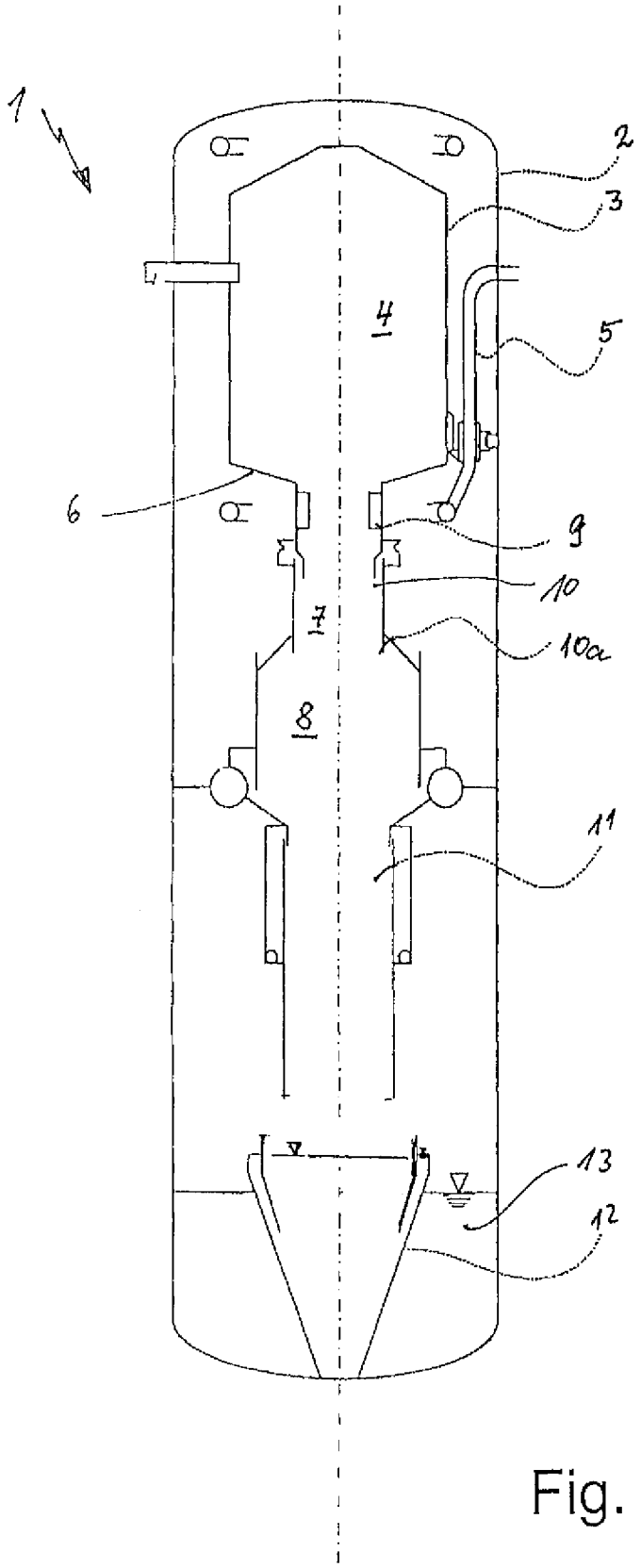

(51) Int. Cl.

| | |
|---|---|
| ***C10J 3/76*** | (2006.01) |
| ***C10J 3/82*** | (2006.01) |
| ***C10J 3/84*** | (2006.01) |

(56) References Cited

U.S. PATENT DOCUMENTS

| | | | | |
|---|---|---|---|---|
| 4,801,306 | A * | 1/1989 | Denbleyker | 48/69 |
| 5,407,455 | A * | 4/1995 | Nilsson | 48/61 |
| 7,744,665 | B2 | 6/2010 | Holle et al. | |
| 2009/0311092 | A1 * | 12/2009 | de Broqueville | 415/203 |
| 2010/0263278 | A1 | 10/2010 | Kowoll et al. | |
| 2011/0010992 | A1 * | 1/2011 | Kowoll | 48/62 R |

FOREIGN PATENT DOCUMENTS

| | | |
|---|---|---|
| WO | WO 2009/036985 | 3/2009 |
| WO | WO 2009/118082 | 10/2009 |

OTHER PUBLICATIONS

International Preliminary Report on Patentability of PCT/EP2010/04337 dated Feb. 7, 2012 and Written Opinion of the International Searching Authority.

* cited by examiner

GASIFICATION REACTOR FOR PRODUCTION OF CRUDE GAS CONTAINING CO OR H2

CROSS REFERENCE TO RELATED APPLICATIONS

This application is the National Stage of PCT/EP2010/004337 filed on Jul. 16, 2010, which claims priority under 35 U.S.C. §119 of German Application No. 10 2009 034 870.0 filed on Jul. 27, 2009, the disclosure of which is incorporated by references. The international application under PCT article 21(2) was not published in English.

The invention relates to a gasification reactor for the production of crude gas containing CO or $H_2$, of the type indicated in the preamble of claim 1.

Such a gasification reactor is known, for example, from WO 2009/036985 A1 by the applicant, whereby a wealth of prior art is cited in this document, such as U.S. Pat. No. 4,474,584, for example, which particularly addresses the cooling of hot synthesis gas.

In particular, the invention concerns itself with problems that occur in such reactors, whereby the invention is not restricted to the gasification reactor that is specifically addressed here; it is also directed at apparatuses in which similar problems, described in greater detail below, can occur.

Such an apparatus must be suitable for allowing methods of pressure gasification/burning of finely distributed fuels, which includes the partial oxidation of the fuels coal dust, finely distributed biomass, oil, tars, or the like in a reactor. This also includes the separate or joint withdrawal of slag or fly ash, and generated synthesis gas or flue gas. Cooling of the reaction products (gas and slag/fly ash) must be made possible, for example by spray quenching, gas quenching, radiation quenching, convective heating surfaces, or the like, depending on the type of method used, whereby finally, attention also has to be directed toward discharge of the reaction products from the pressure container.

In the document WO 2009/036985 A1, as mentioned above, a spin flow is generated, in order to be able to completely react even coarser particles, and to protect critical regions of the heating surfaces from an overly high heat current density. This is brought about by means of a burner angle of 1 to 20° in the horizontal plane. The spin that is produced must be removed from the flow again after it leaves the reactor, so that the hot, sticky slag particles are not accelerated toward the unprotected heating surfaces that protect the pressure container, and cause caking or damage there.

Corresponding spin brakes are described, for example, in DE 10 2009 005 464.2.

It is the task of the present invention to create a solution with which a strand formation of the outflowing ash can be achieved, for one thing, and, for another, a further slag drip edge that ensures optimal slag outflow is made available.

This task is accomplished, according to the invention, in the case of a gasification reactor of the type indicated initially, in that the wall that carries the bulkheads makes a transition, below the bulkheads, into a cylinder wall that is reduced in diameter, by way of a step having a corrugated surface.

By means of the corrugated surface and low points underneath the bulkheads, the result is achieved that the slag can flow out of the corrugation valleys in strands, in targeted manner, and thus no closed slag film is formed.

In addition, it is provided that the cylinder wall, which is reduced in diameter, is enclosed by a further cylindrical wall, which is enlarged in diameter, which wall forms a second slag drip edge at its end, in the direction of gravity, whereby it is provided, in particular, that the further cylindrical wall is disposed to be adjustable in its vertical position, with reference to the first drip edge.

When "adjustability" is mentioned in this connection, this relates to an optical setting relative to the drip edge according to the given conditions, which are determined by operation. After optimization, no further adjustability is required, particularly not during operation of the reactor.

The invention also provides that the cylindrical second drip edge is enclosed by a further cylindrical wall that is enlarged in diameter, which wall encloses at least part of a gas transition region. In practice, this outer cylindrical wall delimits the transition region into the quench space or quench channel.

The invention furthermore also provides that at least one bulkhead of the spin brake is equipped with a device for measuring the heat flow density.

In a possible embodiment, the invention also provides that the second cylindrical wall and the further cylindrical wall are provided with a smooth, flat, corrosion-resistant surface, for example by means of using super-Ω pipes, whereby the bulkheads that reduce spin, the corrugated transition surface, and the cylinder wall that makes the first drip edge available are configured as a standard pipe/crosspiece/pipe wall with stud welding and tamping.

Figure 2:
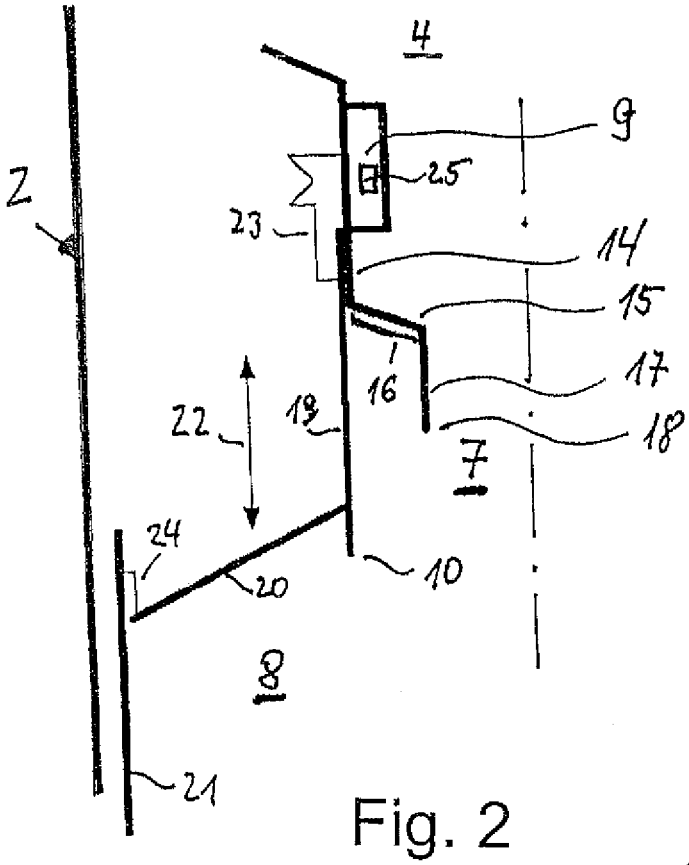
Figure 3:
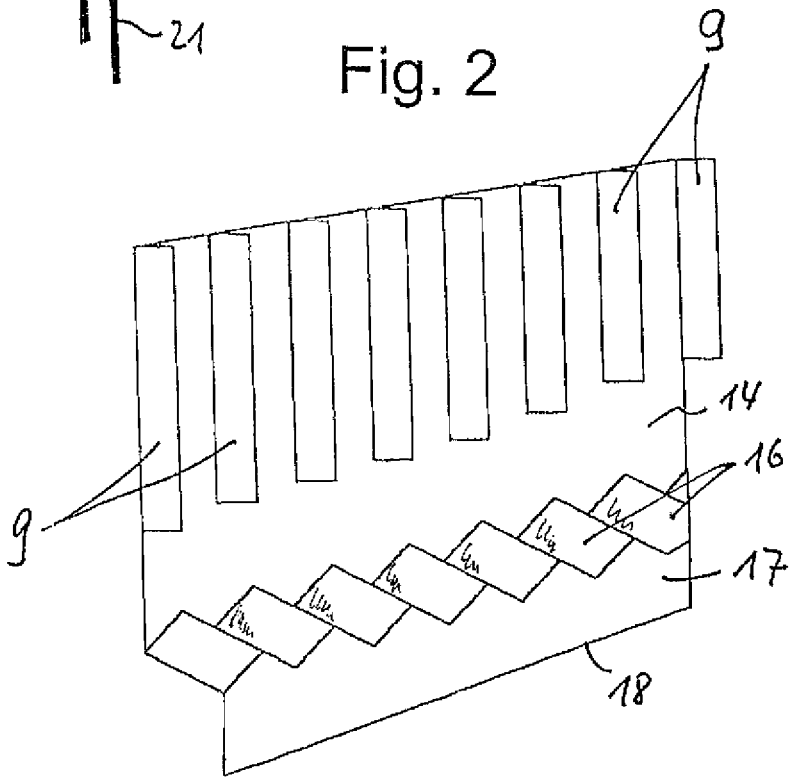

Further details, features and advantages of the invention are evident from the following description and the drawing. This shows, in:

FIG. 1 a schematic sectional drawing through a gasification reactor according to the invention, FIG. 2 a schematic sectional drawing of half of the gasification reactor in the transition region from the reaction chamber to the transition to the quench chamber, which is not shown in any detail, and in FIG. 3 the developed view of the reactor region that forms the transition channel with spin brakes.

The gasification reactor shown in FIG. 1, generally identified as 1, has a pressure container 2, in which a reaction chamber 4 enclosed by a membrane wall 3 is disposed at a distance from the pressure container 2, from top to bottom. The coolant feed line to supply the membrane wall 3 is identified as 5. In this connection, the membrane wall 3 transitions, by way of a lower cone 6, into a narrowed channel, as part of a transitional region identified as 8, whereby spin brakes 9 are indicated in the narrowed transition channel 7. 10*a* identifies a drip edge at the transition region 8 for the liquid ash, in the transition region, at a distance from the first drip edge 10, at the end of the transition channel 7.

Following the transition region 8 is a quench chamber or quench channel 11, followed by a slag collection container 12 in a water bath 13.

As is evident from FIGS. 2 and 3, the wall 14 equipped with the bulkheads 9 that form the spin brake transitions into a step 15 that has a corrugated surface, which is indicated in FIG. 3, whereby the individual corrugations are identified with 16. This in turn is followed by a smooth cylinder wall 17 that is changed in diameter, which makes a first drip edge 18 available.

The transition channel 7, including the configurations of the transition region between the wall 19 and the wall 18 that are used for strand formation of the slag, is enclosed by another cylindrical wall that stands in connection, in gas-tight manner, with the cylindrical wall 21 that encloses the transition chamber 8, by way of the wall disk 20 that is shown at a slant in FIG. 2.

The special feature lies in the fact, for one thing, that the cylindrical wall 19 that encloses the transition channel 7 makes available the further, second drip edge, identified as 10.

Also, according to the invention, the system of cylindrical wall 19 and wall disk 20 is adjustable in height, as indicated with the double arrow 22. The sealing regions or transition regions of the corresponding pipes, through which coolant flows, and which allow such adjustability, are indicated only schematically in FIG. 2 and identified with 23 and 24.

In FIG. 2, it is only indicated symbolically that at least one bulkhead 9 of the spin brake can be equipped with a device 25 for measuring heat flow.

Of course, the exemplary embodiment of the invention that is described can be modified in many ways, without departing from the basic idea. For example, the corrugations 16 that are shown at an angle according to FIG. 3 can be configured to be angular or curved in the corresponding wall step; depending on the use, the piping of the corresponding wall regions can be different, and the like more.

The invention claimed is:

1. A gasification reactor for producing crude gas, containing CO or $H_2$, by gasification of ash-containing fuel with oxygen-containing gas, at temperatures above a melting temperature of the ash, comprising:

(a) a pressure container;

(b) a reaction chamber formed by a membrane wall within the pressure container, wherein coolant flows through the membrane wall;

(c) a gas cooling chamber;

(d) a narrowing transition channel connecting the gas cooling chamber with the reaction chamber;

(e) spin reducing, cooled bulkheads carried by a wall in the transition channel forming a first region having a first diameter, wherein the wall that carries the bulkheads makes a transition, below the bulkheads, by way of a step having a corrugated transition surface into a first cylindrical wall forming a second region having a second diameter smaller than the first diameter, said first cylindrical wall forming a first slag drip edge; and (g) a second cylindrical wall enclosing the first cylindrical wall and forming an enlarged diameter third region, said second cylindrical wall having an end forming a second slag drip edge; and wherein the second cylindrical wall is vertically adjustable with reference to the first slag drip edge.

2. The gasification reactor according to claim 1, wherein the second slag drip edge (10) is enclosed by a third cylindrical wall forming a fourth region that is enlarged in diameter relative to the third region, said third cylindrical wall enclosing at least part of a gas transition region.

3. The gasification reactor according to claim 1, wherein at least one bulkhead of the spin-reducing, cooled bulkheads is equipped with a device for measuring heat flow density.

4. The gasification reactor according to claim 1, wherein the second cylindrical wall and the third cylindrical wall are provided with a smooth, flat, corrosion-resistant surface, wherein the spin-reducing, cooled bulkheads that reduce spin, the corrugated transition surface, and the first cylindrical wall comprise a standard pipe/crosspiece/pipe wall with stud welding and tamping.

* * * * *